United States Patent [19]

Saltzman

[11] Patent Number: 4,489,566

[45] Date of Patent: Dec. 25, 1984

[54] CRUSHED ICE MAKING METHOD AND APPARATUS

[76] Inventor: Robert Saltzman, 7420 SW. 163rd St., Miami, Fla. 33157

[21] Appl. No.: 488,144

[22] Filed: Apr. 25, 1983

[51] Int. Cl.[3] ..... F25C 5/10

[52] U.S. Cl. ..... 62/73; 62/352

[58] Field of Search ..... 62/69, 70, 73, 352

[56] References Cited

U.S. PATENT DOCUMENTS

| | | | |
|---|---|---|---|
| 2,133,521 | 10/1938 | Wussow et al. | 62/70 X |
| 2,595,588 | 5/1952 | Lee et al. | 62/73 |
| 2,648,955 | 8/1953 | Lee et al. | 62/71 |
| 2,921,443 | 1/1960 | Lee | 62/69 |
| 3,206,945 | 9/1965 | Nilsson et al. | 62/352 |

*Primary Examiner*—William E. Tapolcai
*Attorney, Agent, or Firm*—Robert W. Fiddler

[57] ABSTRACT

A crushed ice making method and apparatus in which water is introduced into the upper end of a tubular column open at the top and having a constricted air inlet at the lower end into which air is introduced in counterflow to the water. The column is positioned in heat exchange relationship with a refrigerant flow path, and the temperature of the refrigerant in this flow path is selectively controlled to either freeze the water in the column or thaw any ice formed therein to free the ice from the column side walls to effect ice harvesting. When ice of desired thickness has formed in the column, the air inlet is closed off by the ice, causing a pressure build-up in the air supply line. This pressure is sensed and employed to actuate control means causing hot refrigerant to flow in the refrigerant flow path in heat exchange relationship with the column to free the ice in the column from the side walls thereof, at which time the air pressure acts to force the ice upwardly out of the column. The upper open end of the column is constricted by ice crushing blades and coupled to an elbow serving to provide a leak free path for the expelled ice at an angle to the axis of the column. Heating means are provided to heat the upper end of the column during freezing so as to prevent any blockage of ice discharged during harvest.

16 Claims, 2 Drawing Figures

CRUSHED ICE MAKING METHOD AND APPARATUS

BACKGROUND OF THE INVENTION

This invention relates to the art of crushed ice making and more particularly to an improved apparatus and method permitting automatic and continuous crushed ice formation with no relatively moving mechanical parts in the flow path of the water to be frozen or the formed ice.

A variety of ice making apparatus has been evolved for forming crushed ice, and/or for forming elongate columns or blocks of ice.

Thus, Lee et al in U.S. Pat. No. 2,597,008, discloses an apparatus and method for forming crushed ice, in which a column of water is contained within a tube in heat exchange relationship with a refrigerant flow path, with the refrigerant acting to freeze water flowing through the tube. When the water in the tube has been frozen, relatively warm city water main water is directed externally of the tube in a flexible defroster sleeve to defrost the formed ice adjacent the tube wall, and the pressure of the thawing water is employed to expel the ice column from the top of the tube, which is provided with a deflector plate at the tube outlet serving to break the ice being ejected from the tube.

Lee et al in U.S. Pat. No. 2,595,588 attempted to improve on the U.S. Pat. No. 2,597,008 disclosure by utilizing air under pressure introduced into the lower end of the ice forming tubes to eject the formed ice.

Lee et al in U.S. Pat. No. 2,648,955 attempted to improve on the U.S. Pat. No. 2,597,008 disclosure by utilizing a knife blade positioned in the path of the ejected ice to effect crushing of the formed ice.

Hoen, in U.S. Pat. No. 2,768,507 discloses a freezing apparatus for making ice blocks in which a refrigerant jacket is arranged in heat exchange relationship with an ice forming column. Water is sucked upwardly into the column to be frozen, and after freezing, air pressure is employed to eject the formed column of ice downwardly from the freezing column. The formed ice drops into a water supply tank where it is recovered in a receiving device.

The previously evolved apparatus and methods as above described employed relatively complex structures, and methods of operation, in which the ice crushing blade elements require relatively continuous maintenance and replacement due to the crushing action of the ice thereon. Further, in attempting to effect harvesting, it is found in commercial embodiments of these structures that there is a problem in thawing the ice to effect harvesting.

BRIEF DESCRIPTION OF THE INVENTION

It is with the above considerations in mind that the present, improved crushed ice making apparatus and method have been evolved, serving to permit the relatively automatic and continuous formation and harvesting of crushed ice, with the water to be frozen and the formed ice not contacting relatively movable mechanical parts, and with the ice crushing components subject to minimal deterioration, as a result of any crushing action on the ice.

Among the features of the invention is the capacity of any apparatus embodying the invention or utilizing the method to employ salt water to form ice due to the fact that the normally deleterious effect of salt water on relatively moving metal parts is minimized, thus permitting the use of the apparatus on board ship, to freeze available sea water.

Another feature of the invention resides in the use of a relatively simple pressure responsive control sensing air pressure in the air supply line to indicate ice formation, and thereafter initiate ice harvesting.

A further feature of the invention resides in the use of constricting blades constricting the outlet opening of the ice forming chamber to effect crushing.

Another important feature resides in the use of a heating element adjacent the water inlet and ice outlet end to insure that there will be no ice blocking freeze up interfering with ice harvesting.

These features are employed in the formation of ice in a tubular column open at the top and having a constricted air inlet at the lower end, with the column positioned in heat exchange relationship with a refrigerant flow path, which may be selectively coupled to either the suction or discharge end of a refrigerant compressor to permit either hot or refrigerating refrigerant to be brought into heat exchange relationship with the column and any liquid contained therein. A water supply line is coupled to feed water into the top of the column, and an air supply line is coupled to the air inlet at the bottom of the column, so that water and air may be flowed through the column in opposite directions with the air flow such as to keep the water in the column. The upper open end of the column is formed with opening constricting crushing blades forcing the ejected ice in on itself to effect crushing. The upper end of the column is heated preferably by hot refrigerant in the system to insure that there will be free passage of ice during harvesting. When ice of desired thickness has formed in the column, the lower constricted air inlet is closed off by the ice, causing a pressure build-up in the air supply line. This pressure build-up is sensed by a pressure sensing means, preferably a pressure responsive switch, and the flow of refrigerating refrigerant is discontinued and replaced by hot refrigerant, preferably by utilizing a solenoid actuated defrost valve in the refrigerant line. Upon thawing of the ice layer adjacent the interior surface of the column wall, the pressure build-up in the air supply line acts to eject the ice from the column past the crushing blades along a discharge path at an angle to the axis of the column, preferably formed by an elbow coupled to the column top.

BRIEF DESCRIPTION OF THE DRAWINGS

The specific details of a preferred embodiment of the invention and of the manner and process of making and using it and of the best mode contemplated for practicing in the invention, will be described in full, clear, concise and exact terms, in conjunction with the accompanying drawing, wherein.

DESCRIPTION OF PREFERRED EMBODIMENT

Figure 2:
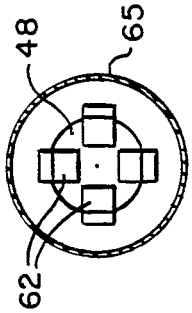
FIG. 2 is a cross-sectional view on line 2—2 of FIG. 1 showing the constricting ice crushing blades.
Figure 1:
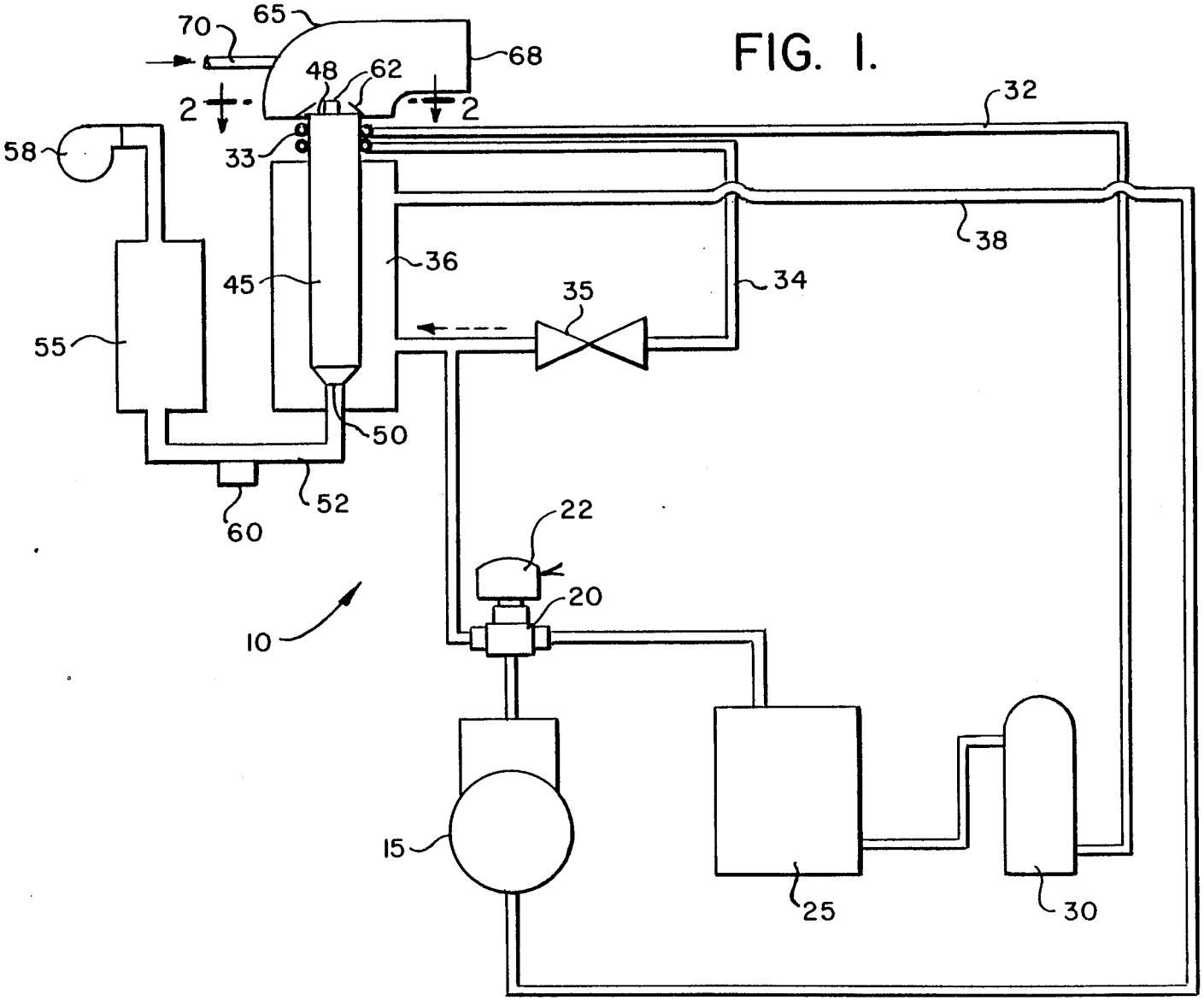
FIG. 1 is a schematic view of a crushed ice making system embodying the instant invention.

Referring now more particularly to the drawings, crushed ice making apparatus 10 is illustratively shown utilizing a compression refrigeration system having a compressor 15, which is coupled to solenoid actuated two-way valve 20 controlled by solenoid 22. During normal refrigerating operation, valve 20 passes compressed refrigerant gas to condenser 25 and then to liquid refrigerant receiver 30 from which liquid refrigerant is fed via liquid refrigerant line 32 to heating coils 33 through line 34 to expansion valve 35, which is coupled to evaporator jacket 36, from which evaporated refrigerant is fed via evaporated refrigerant suction line 38, back to compressor 15.

Arranged within evaporator jacket 36, is a tubular water confining column 45, open at the top to provide water inlet 48, and open at the bottom with a constricted air inlet opening 50. Air inlet 50 is coupled via air supply line 52 to an air tank 55 connected to air pump 58 and pressure responsive switch 60 is positioned to sense the pressure in air supply line 52.

The top of the open tubular column 45 is provided with constricting compression plates 62 acting to constrict the ice discharge path. Arranged over the ice forming tubular column 45 is discharge elbow 65, having ice discharge outlet 68 and water inlet connection 70, which leads to a water supply source, preferably with some means for maintaining water flow until the column is filled to its top. A float controlled valve in a tank having a water level like that of the column top may be employed.

The heating refrigerant flow path 32 leading from receiver 30 to heating coils 33 is arranged in heat exchange relationship with the top of column 45 adjacent the water inlet 48.

OPERATION

In use, the aforedescribed components are fabricated employing conventional sheet metal, plumbing and other standard production techniques required to establish desired refrigerant water and air flow paths coupled to the above described conventional mechanical components.

It is preferred that electrical connections be made between the pressure sensitive switch 60 and the solenoid 22 of solenoid valve 20, so that when a given pressure is sensed by switch 60 in air supply line 52, solenoid 22 will cause valve 20 to move to direct hot compressed refrigerant from compressor 15 to jacket 36. The water supply is controlled to limit the flow of water to column 45, so as to fill, but not overflow, the column. This has been conveniently accomplished by means of a float positioned in a water supply tank the level of which is maintained at the desired level of water in column 45 with the float shutting a water supply valve as the level of the column rises to a desired fill position.

At start-up, the operation of the refrigeration system, water supply system, and air supply system, are initiated. Air pump 58 fills air tank 55 with air. The water supply directs water to column 45 against the flow of air which is maintained at a rate to retain the water in the column. The evaporating refrigerant in evaporator 36 produces freezing of the water in column 45. Freezing of water at the inlet 48 is prevented by the presence of heating coils 33. When the water in column 45 has been frozen to a point obstructing the air inlet 50, there is a pressure build-up in air supply line 52, which actuates pressure responsive switch 60 to actuate solenoid 22 to move valve 20 to close off refrigerant flow to condenser 25 and direct it to the jacket 36, which now receives the hot compressed refrigerant to effect thawing of the ice in column 45 adjacent the inner column wall.

Upon thawing of this wall layer of ice, the ice column is freed from the walls, and the air under pressure at the bottom of the ice column forces the column upwardly through the open top of the column against the compression plates 62 breaking the ice. The elbow 65 directs the crushed ice that is ejected.

The above disclosure has been given by way of illustration and elucidation, and not by way of limitation, and it is desired to protect all embodiments of the herein disclosed inventive concept within the scope of the appended claims.

I claim:

1. Means for forming crushed ice, comprising:
- means confining water in a column;
- means introducing water into the upper end of said column;
- refrigeration means having a refrigeration flow path in heat exchange relationship with the water in said column;
- air supply means providing air to the bottom of said means confining water;
- pressure sensing means sensing the pressure of the air supplied;
- valve means controlled by said air pressure sensing means to direct either hot or cold refrigerant to the refrigeration flow path, whereby upon freezing of the water in said confining means, air flow will be restricted, causing a pressure build-up against the formed ice to discharge same from the confining means; and
- heating means arranged in heat exchange relationship with the upper end of said means confining water in a column while the lower portion of said water confining means is in heat exchange relationship with expanding heat absorbing refrigerant.

2. Means for forming crushed ice, as in claim 1, in which said means confining the water comprise an elongate tube.

3. Means for forming crushed ice, as in claim 2, in which said refrigerant means comprise a compression refrigeration system having an evaporator jacketing said tube in normal ice forming position.

4. Means for forming crushed ice as in claim 1, in which compression blade means are formed at the top of said confining means to compress and crush the ice discharged therefrom.

5. Means for forming crushed ice, as in claim 3, in which said pressure sensing means comprise a pressure responsive switch positioned to respond to the pressure in said air supply line.

6. Means for forming crushed ice, as in claim 5, in which said valve means controlled by said pressure sensing means comprise a solenoid actuated hot gas valve.

7. Means for forming crushed ice, as in claim 1, having an ice discharge path from said column at an angle to the axis of said column.

8. A method of forming crushed ice comprising the steps of:
- introducing water into the upper end of a column having a constricted opening at its top;
- arranging a refrigerant flow path in heat exchange relationship with the water in the column;
- introducing air into a constricted opening in the lower end of the column flowing opposite to the flow of water;
- lowering the temperature of the water until the water in the column is frozen into ice;
- restricting the flow of air into the column as ice accumulates building up air pressure at the bottom of the ice column;

applying air to the bottom of the ice to expel the ice in the column through its constricted open top to compress and break the column of ice; and heating the upper end of the column while the water in the column is being frozen.

9. A method of forming crushed ice, as in claim 8, in which the temperature of the side walls of the column are raised to free the ice therefrom before expelling the ice from the column.

10. A method as in claim 9, in which the temperature of the column side walls is raised by flowing hot refrigerant in heat exchange relationship with the column side walls.

11. A method, as in claim 10, in which the step of raising the temperature is performed in response to a rise in air pressure.

12. A method, as in claim 8, in which the constriction of the column is performed by positioning blades about the upper opening.

13. A crushed ice making machine comprising:

a compression refrigeration system having a compressor and an evaporator through which vaporizing refrigerant may be passed;

an ice forming chamber in heat exchange relationship with said evaporator;

an air inlet to said chamber;

a water inlet at the upper end of said ice forming chamber spaced from said air inlet;

an air supply line coupled to said air inlet;

an air pressure sensitive switch positioned in pressure sensing relationship to the air in said supply line;

a solenoid actuated hot gas valve coupled to said pressure sensitive switch controlling the flow of refrigerant from the compressor, whereby upon freezing of water in said chamber, air flow therethrough will be restricted, causing an air pressure build-up sensed by said air pressure sensitive switch which will actuate the hot gas valve to pass hot refrigerant through the evaporator to release the formed ice from the chamber sidewalls to permit ejection from said chamber; and a hot gas refrigerant flow path forming part of the refrigerant path of said compression refrigeration system in heat exchange relationship with the upper end of said chamber to heat this upper end, while the water in the column is being frozen.

14. An ice making machine, as in claim 13, in which said ice forming chamber comprises an elongate tubular column having an open upper end and a constricted air inlet opening.

15. An ice making machine as in claim 14, having ice crushing compression blades constricting the upper open chamber end through which the formed ice is discharged.

16. An ice making machine, as in claim 14, in which said column is formed with an elbow at the top thereof directing any ice discharged from said column.

* * * * *